United States Patent [19]

Taniuchi

[11] 3,996,867

[45] Dec. 14, 1976

[54] PROCESS AND APPARATUS FOR FORMING TEARABLY DETACHABLE PORTION ON SHEET

[76] Inventor: Keiji Taniuchi, No. 6-7, 2-chome, Nishi-Koujiya Ohta, Tokyo, Japan

[22] Filed: . Feb. 21, 1975

[21] Appl. No.: 551,657

[30] Foreign Application Priority Data

May 2, 1974 Japan ..... 49-48721
Dec. 24, 1974 Japan ..... 49-147588

[52] U.S. Cl. ..... 113/1 F; 113/116 QA; 113/121 C

[51] Int. Cl.[2] ..... B21D 51/00

[58] Field of Search ..... 113/1 F, 116 R, 120 Q, 113/121 R, 121 A, 121 C, 15 A, 15 R, 116 QA, 116 V; 72/324, 326, 332; 83/1, 5, 6, 7, 51

[56] References Cited

UNITED STATES PATENTS

| | | | |
|---|---|---|---|
| 3,362,569 | 1/1968 | Geiger | 220/48 |
| 3,563,199 | 2/1971 | Wolfe | 113/121 C |
| 3,741,142 | 6/1973 | Stuard | 113/121 C |
| 3,870,001 | 3/1975 | Brown | 113/121 C |
| 3,875,884 | 4/1975 | Zundel | 113/121 C |
| 3,881,437 | 5/1975 | Lovell et al. | 113/121 C X |

FOREIGN PATENTS OR APPLICATIONS

| | | | |
|---|---|---|---|
| 356,467 | 11/1905 | France | 113/15 A |
| 22,359 | 5/1907 | Sweden | 113/15 A |
| 399,065 | 9/1933 | United Kingdom | 113/15 A |

*Primary Examiner*—C.W. Lanham
*Assistant Examiner*—Gene P. Crosby
*Attorney, Agent, or Firm*—Zarley, McKee, Thomte & Voorhees

[57] ABSTRACT

The periphery of a tearably detachable portion of a sheet such as the lid of a pop-top can is weakened by cutting a groove around the periphery. The portion is then recessed by a die set, the periphery of the portion being further weakened by plastic deformation.

7 Claims, 5 Drawing Figures

PROCESS AND APPARATUS FOR FORMING TEARABLY DETACHABLE PORTION ON SHEET

The present invention relates to a process and apparatus for forming a tearably detachable portion on a sheet such as the lid of a pop-top can.

It is well known and popular to provide beverage and other cans with pop-top lids. A continuous groove of suitable shape is cut in the surface of the can lid to define a tearably detachable portion, and a handle or tab is riveted to the portion near the periphery. The portion or pop-top is torn from the can by pulling the tab back across the surface of the portion.

A problem is encountered in the manufacture of pop-top cans in that a tremendous force is required to cut a continuous groove in the top of the steel can lid deep enough that the portion can be easily and cleanly torn from the lid, since the groove is cut in one operation by a die. Apparatus with sufficient power to perform such a grooving operation on a steel can lid must necessarily be massive in size and expensive to manufacture and operate. The problem is generally overcome in practice by making the can body out of steel and the can lid out of aluminum, which is much easier to form than steel. However, aluminum is more expensive than steel, adding to the cost of the can. Aluminum cans and lids for this reason are sometimes recycled. However, due to the high cost of recycling involving separation of the can lids and the can bodies from each other, it is highly desirable in the art of making cans to make the cans entirely out of steel so that the cans can be easily recycled without separating the can lids from the can bodies.

It is therefore an important object of the present invention to provide a process for forming a tearably detachable portion or pop-top on a can which can be applied to steel can lids.

It is another object of the present invention to provide apparatus for performing the above process.

It is another object of the present invention to provide apparatus to form a tearably detachable portion on a sheet of metal, which may be a can lid, utilizing less power than prior art apparatus.

It is another object of the present invention to provide apparatus to form a tearably detachable portion on a can lid, the apparatus being smaller in size and less expensive to manufacture and operate than prior art apparatus.

The above and other objects, features and advantages of the present invention will become clear from the following detailed description taken with the accompanying drawings, in which.

Figure 1:
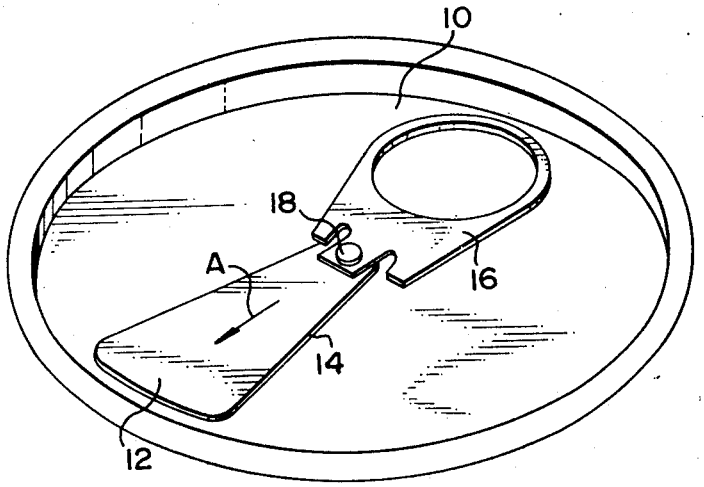
FIG. 1 is a perspective view of a pop-top can lid formed in accordance with the present invention.

Referring now to FIG. 1, a pop-top can lid 10 (the can is not shown) is formed with a tearably detachable portion 12. The portion 12 is recessed from the remainder of the can lid 10 and is defined by a continuous wall 14. The portion 12 may be of any desired shape, but is preferably of the shape shown which is known in the art. A handle or tab 16 formed with a hole (no numeral) is fastened to the portion 12 near the wall 14 by a rivet 18. A person desiring to open the can inserts a finger through the hole in the tab 16 and pulls the tab in the direction of an arrow A. This operation causes the attached portion 12 to be cleanly and easily torn from the remainder of the lid 10.

Figure 2:
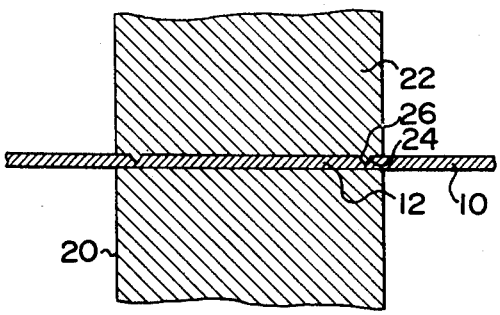
FIG. 2 is a fragmentary sectional view of dies embodying the present invention performing the first step of a two step forming process on a can lid.

Prior art pop-top can lids are not recessed, and are formed as shown in FIG. 2. Lower and upper dies 20 and 22 respectively have flat surfaces. The upper die 22 is formed with a sharp continuous ridge 24 having the shape of the periphery of the portion 12. The height of the ridge 24 must be less than the thickness of the lid 10 so that the lid 10 will not be pierced. The dies 20 and 22 are brought together with tremendous force so that the ridge 24 cuts a V-shaped continuous groove 26 in the lid 10. The groove 26 represents the weakest part of the lid 10, and will yield when the tab 16 is pulled so that the portion 12 is cleanly torn from the lid 10. The present invention is essentially a two step process for forming the portion 12, although the two steps may be performed simultaneously. The first step may be identical to that shown and described with reference to FIG. 2, except that the force applied to bring the dies 20 and 22 together is much lower than in prior art processes. It is not necessary to cut the groove 26 so deeply that the portion 12 can be torn from the lid 10 after performing the first step of the process.

Figure 3:
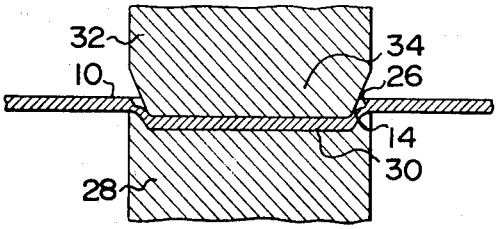
FIG. 3 is similar to FIG. 2, but shows other dies performing the second step of the process.

The second step of the process may be performed as shown in FIG. 3. Another lower die 28 and another upper die 32 are provided. The lower die 28 is formed with a recess 30 and the upper die 32 is formed with a protrusion 34 conjugate to the recess 30. The shapes of the protrusion 34 and recess 30 are essentially the same as the periphery of the portion 12.

In operation, the dies 28 and 32 are brought together with sufficient force to recess the portion 12, the wall 14 being formed by elastic and/or plastic deformation of the material of the lid 10, which is preferably steel, in a manner well known in the art of metal working. The metal in the area of the groove 26 is considerably weaker than the remainder of the lid 10. In accordance with an important feature of the present invention, the metal defining the groove 26 is plastically elongated by performing the second step of the process as shown in FIG. 3, so that said metal becomes even further weakened to the extent that the portion 12 may be easily torn from the lid 10. The weakening of the periphery of the portion 12 is performed in two steps in accordance with the invention so that the force applied to the lid 10 to form the portion 12 may be much lower than if the process is performed in only one step.

Figure 4:
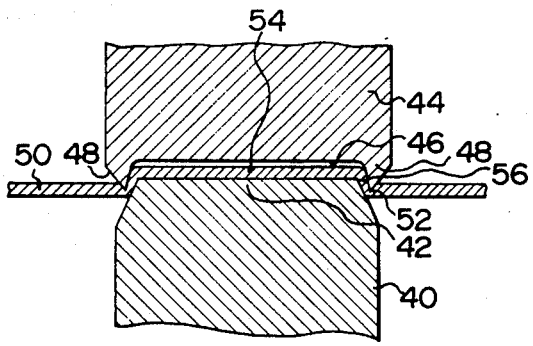
FIG. 4 is a fragmentary sectional view of dies adapted to perform both of the steps simultaneously on a can lid.

The two steps may be performed simultaneously by one set of dies as shown in FIG. 4. A lower die 40 is formed with a protrusion 42 similar to the protrusion 34. An upper die 44 is formed with a recess 46 similar to the recess 30. The lid is designated as 50, the detachable portion by 54, the continuous groove by 52 and the wall by 56. The periphery of the recess 46 of the upper die 44 is formed into a sharp ridge 48. As the dies 40 and 44 are brought together, the ridge 48 cuts the groove 52 in the lid 50 while the protrusion 42 and recess 46 recess the portion 54 of the lid 50.

Figure 5:
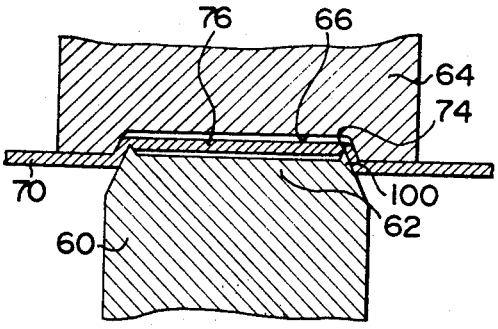
FIG. 5 is similar to FIG. 4, but shows a modification of the dies.

FIG. 5 shows a modification of the simultaneous process of FIG. 4. A lower die 60 is formed with a protrusion 62. An upper die 64 is formed with a conjugate recess 66. The can lid is designated as 70, the wall by 72, the groove by 74 and the detachable portion by 76. In this case, a sharp ridge 100 is formed around the periphery of the protrusion 62 of the die 60. As the dies 60 and 64 are brought together, the ridge 100 cuts the groove 74 while the protrusion 62 and recess 66 recess the portion 76 of the lid 70. It will be noticed that in FIG. 4, the groove 52 is formed outside the wall 56, whereas in FIG. 5, the groove 74 is formed inside the wall 72.

What is claimed is:

1. A process for forming a tear off detachable portion on a sheet of distendable material comprising the steps of:

a. forming a continuous groove in said sheet of distendable material to define a first lid portion, said groove being substantially V-shaped in section;

b. recessing said first lid portion with respect to said sheet to create a deformed and distended wall which is positioned adjacent said lid portion whereby said groove and said deformed and distended wall cooperate to provide a weakened portion adjacent the perimeter of said first lid portion to permit said first lid portion to be easily detached from the remainder of said sheet.

2. The process of claim 1, in which steps (a) and (b) are performed simultaneously.

3. The process of claim 1, in which step (b) is performed after step (a).

4. The process of claim 1 wherein said wall is positioned outwardly of said groove.

5. The process of claim 1 wherein said wall is positioned inwardly of said groove.

6. An apparatus for forming a tear off detachable portion on a sheet of distendable material comprising, first die means having a protrusion, said protrusion having a continuous ridge formed on the surface thereof for forming a continuous groove in the sheet to define a first lid portion, second die means having a recessed portion for matingly receiving said protrusion of said first die means, said second die means having a wall portion which is positioned laterally with respect to the continuous ridge of said first die means whereby compressing said first die means into said second die means creates a deformed and distended wall in said sheet adjacent the perimeter of said first lid portion so that the said groove and deformed wall may cooperate to provide a weakened portion adjacent the perimeter of said first lid portion to permit said first lid portion to be easily detached from the remainder of the sheet.

7. The apparatus of claim 6 wherein said second die means is arranged so that said wall is formed outwardly of said groove.

* * * * *